United States Patent [19]

Tomita

[11] Patent Number: 4,487,992

[45] Date of Patent: Dec. 11, 1984

[54] SHIELDED ELECTRICAL CABLE

[75] Inventor: Akira Tomita, Yamato, Japan

[73] Assignee: AMP Incorporated, Harrisburg, Pa.

[21] Appl. No.: 530,310

[22] Filed: Sep. 8, 1983

[30] Foreign Application Priority Data

Sep. 11, 1982 [GB] United Kingdom ..... 8225990

[51] Int. Cl.[3] ..... H01B 11/20; H01B 7/08

[52] U.S. Cl. ..... 174/36; 174/115; 174/117 F

[58] Field of Search ..... 174/36, 115, 117 F

[56] References Cited

U.S. PATENT DOCUMENTS 3,775,552 11/1973 Schumacher ..... 174/36 X
4,234,759 11/1980 Harlow ..... 174/117 F X
4,412,093 10/1983 Hansell ..... 174/117 F X
4,424,403 1/1984 Bogese ..... 174/36

FOREIGN PATENT DOCUMENTS 2644252 3/1978 Fed. Rep. of Germany ... 174/117 F
2047947 12/1980 United Kingdom ..... 174/117 F

*Primary Examiner*—John F. Gonzales
*Assistant Examiner*—Morris H. Nimmo
*Attorney, Agent, or Firm*—Adrian J. LaRue

[57] ABSTRACT

In an electrical cable comprising a plurality of conductors extending in a spaced parallel relationship in a common plane surrounded by outer layers of insulating material joined by web portions, certain conductors are surrounded by inner layers of insulating material which are in turn surrounded by individual foil shielding layers, the shielding layers being interconnected and connected to at least one other conductor by a shielding connection member in the form of a foil which extends through the web portions of the cable.

3 Claims, 2 Drawing Figures

SHIELDED ELECTRICAL CABLE

FIELD OF THE INVENTION

This invention relates to shielded electrical cable.

BACKGROUND OF THE INVENTION

Coaxial electrical cables are well known, such cables generally being terminated by the use of electrical connectors having coaxial conductive members separated by dielectric material.

Also known are shielded electrical cables comprising one or more insulated signal conductors surrounded by a shielding layer formed, for example, by a metal foil. To facilitate termination of such a cable, a further uninsulated conductor is sometimes provided between the shielding layer and the insulation of the signal conductor or conductors, termination of this further conductor constituting termination of the shielding layer. Such a cable is disclosed in U.S. Pat. No. 3,775,552.

Both these known forms of cable normally require the use of specifically designed connectors for termination, these connectors not being suitable for the use of mass termination techniques, that is the simultaneous connection of a plurality of conductors to individual contacts in a connector, but requiring individual attention. This is a particular problem with cables comprising a plurality of conductors arranged in a planar array in a common insulating body, when it is desired to use a connector having so-called slotted plate contacts each having a plate portion having a slot open to one edge of the plate into which slot a conductor can be urged such that the slot walls grip the conductor and establish an electrical connection between the conductor and the contact.

In U.S. patent application Ser. No. 383,638 filed June, 1, 1982, an electrical cable is disclosed comprising an outer layer of insulating material surrounding a signal conductor and an associated ground conductor and a common shielding layer in electrical contact with the ground conductor but separated from the signal conductor by an inner layer of insulating material surrounding the signal conductor, characterized in that the signal and ground conductors extend in spaced parallel relationship in a common plane, each surrounded by an individual outer layer of insulating material, the two outer layers of insulating material being integrally formed with a web extending between the two outer layers of insulating material, the shielding layer extending about the inner layer of insulating material on the signal conductor, through the web, and about the ground conductor.

Such a cable has the advantage that the spacing between the signal and ground conductors can be set to accord with the spacing between the relevant contacts in a connector to be used to terminate the cable whereby a mass termination technique can be used without the operator having to rearrange the cable conductors.

Preferably the signal and ground conductors are substantially the same size, and the diameter of the outer layer of insulating material surrounding the ground conductor is substantially equal to the diameter of the inner layer of insulating material surrounding the signal conductor.

Such a choice of dimensions enables the use of slotted plate contacts having the same size slots for termination of the signal and ground conductors, thus facilitating assembly of a connector to be used to terminate the cable since identical contacts can be used for all conductors. For termination, the outer layer of insulating material and the shielding layer are stripped from a length of the signal conductor, thus leaving an insulated signal conductor and a ground conductor surrounded by the shielding layer and the outer layer of insulating material, of substantially equal diameter.

A composite cable can be formed from a plurality of such cables arranged in side-by-side relationship, the cables being connected by an integrally formed web extending between the outer layers of insulating material of the cables.

Such a composite cable can be readily mass terminated with a minimum of pre-preparation using conventional techniques and a connector having a plurality of contacts with identical slotted plate contact portions, the conductors in the cable being spaced in accordance with the spacing of the associated contacts of the connector.

In the cable specifically disclosed in the above-noted application, each signal conductor has an individually associated ground conductor, each pair of conductors having an individually associated shielding layer.

However, such an arrangement is not always essential, it being possible for a single ground conductor to be associated with a plurality of signal conductors.

In GB-A-2047947, such a cable is disclosed in which the shielding layer surrounding the inner layer of insulating material surrounding each signal conductor, extending through the webs, and about the ground conductor is formed from a single layer of conductive polymer. However, this prior specification does not disclose the conductor and insulation size relationships discussed above.

SUMMARY OF THE INVENTION

According to this invention, an electrical cable comprises a plurality of conductors extending in spaced parallel relationship in a common plane each surrounded by an outer layer of insulating material, the outer layers of insulating material around each conductor being integrally formed with web portions extending between adjacent conductors, each of certain conductors which in use constitute signal conductors, being surrounded by a shielding layer separated from the conductor by an inner layer of insulating material surrounding the conductor, the shielding layer being extended through the web portions between adjacent conductors, and being in direct contact with at least one other conductor which in use constitutes a ground conductor, characterized in that each signal conductor is surrounded by an individual shielding layer surrounding the inner layer of insulating material surrounding the conductor, a shielding connection member extending through the web portions and contacting the individual shielding layer of each signal conductor and contacting said one other conductor thereby to establish connections between the individual shielding layers and said one other conductor.

BRIEF DESCRIPTION OF THE DRAWING

An electrical cable according to the invention will now be described by way of example with reference to the drawing, in which.

DETAILED DESCRIPTION OF THE INVENTION

Figure 1:
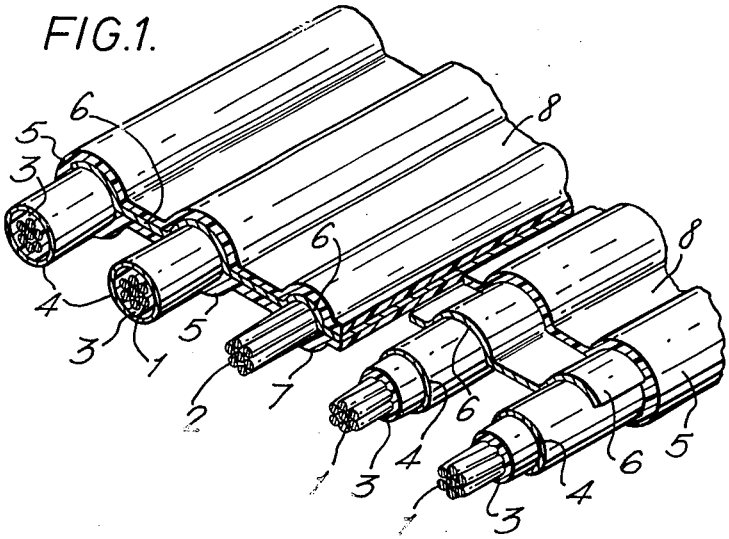
FIG. 1 is a perspective view of the cable.
Figure 2:
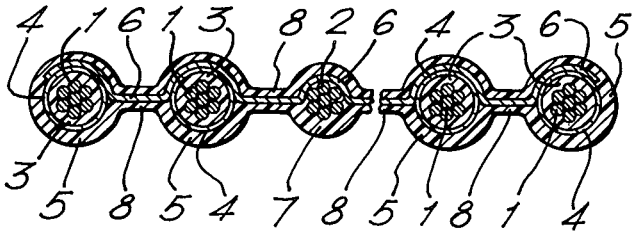
FIG. 2 is a transverse sectional view through the cable.

The cable comprises four seven-strand signal conductors 1 and a single seven-strand ground conductor 2, the conductors 1 and 2 being substantially the same size.

Each signal conductor 1 is surrounded by an inner layer 3 of insulating plastic material, which is in turn surrounded by an individual shielding layer 4 formed, for example, of an aluminum foil. The shielding layer 4 is in turn surrounded by an outer layer 5 of insulating plastic material.

The signal and ground conductors 1 and 2 are arranged in spaced parallel relationship in a planar array, the spacing between adjacent conductors being equal to the spacing between adjacent contacts in a connector to be used to terminate the cable.

The ground conductor 2 is contacted by a shielding connection member 6 in the form of a metal foil, and is surrounded by an outer layer 7 of insulating plastic material.

The outer layers 5 and 7 of insulating material surrounding adjacent conductors 1, or 1 and 2, and joined by integrally formed web portions 8 through which the shielding connection member 6 extends, the shielding connection member 6 being in electrical contact with the individual shielding layer 4 of each signal conductor 1.

Thus the individual shielding layer 4 of each signal conductor 1 serves to shield the signal conductor 1 throughout its length and can easily be terminated at a connector in a similar manner to the signal conductor 1 by means of the ground conductor 2 which is electrically connected thereto by the shielding connection member 6.

For termination of the cable, the outer layer 5 of insulating material and the individual shielding layer 4 and shielding connection member 6 are removed from a length of each signal conductor 1 to leave the signal conductor 1 with the inner layer 3 of insulating material thereon substantially equal in diameter to the diameter of the ground conductor 2 with the shielding connection member 6 and outer layer 7 of insulating material thereon. The web portions 8 with the shielding connection member 6 are also removed from between adjacent conductor 1, or 1 and 2.

The cable can then be terminated using conventional mass termination apparatus (not shown) and using a connector having contacts with identical insulation displacement contact portions, in known manner.

The cable of this invention can be manufactured using known extrusion techniques which do not require detailed description herein.

I claim:

1. A shielded electrical cable, comprising:

a plurality of coaxial cables, each of the coaxial cables including a signal conductor, an insulating sheath surrounding the signal conductor and an outer conductor surrounding the insulation sheath;

a ground conductor extending in the same direction as said coaxial cables with the coaxial cables and the ground conductor being disposed in a substantially planar array;

an outer layer of insulating material covering the coaxial cables and the ground conductor thereby maintaining the coaxial cables and the ground conductor in ribbon form and defining web means between the respective coaxial cables and the ground conductor so that the coaxial cables and the ground conductor remain parallel and spaced with respect to one another;

electrical conductive means disposed within the outer layer of insulating material, electrically engaging respective outer conductors of the coaxial cables therealong, extending through the web means and electrically engaging the ground conductor thereby electrically connecting all of the outer conductors of said coaxial cables to said ground conductor; and the diameter of the outer layer of insulating material surrounding the ground conductor being substantially the same as the insulation sheath surrounding each signal conductor so that exposed insulation sheaths containing the signal conductors therein and the insulated ground conductor can be mass terminated in terminating sections of electrical terminals positioned at spaced intervals in a housing member corresponding to the spacing between the signal conductors and ground conductor.

2. A shielded electrical cable as set forth in claim 1, wherein the signal and ground conductors are substantially the same size.

3. A shielded electrical cable as set forth in claim 1, wherein the outer conductors and electrical conductive means are metal foils.

* * * * *